United States Patent [19]

Hudson

[11] Patent Number: 4,932,568

[45] Date of Patent: Jun. 12, 1990

[54] TIP-OVER DRUM

[75] Inventor: Donald S. Hudson, Norwell, Mass.

[73] Assignee: Pneumatic Scale Corporation, Quincy, Mass.

[21] Appl. No.: 368,164

[22] Filed: Jun. 14, 1989

Related U.S. Application Data

[63] Continuation of Ser. No. 166,119, Mar. 10, 1988, abandoned.

[51] Int. Cl.[5] ..... G01F 11/10

[52] U.S. Cl. ..... 222/368; 222/367; 222/410; 222/414; 193/10

[58] Field of Search ..... 222/56, 77, 368, 410, 222/414, 548, 555, 367; 193/47–48, 44–45, 10; 198/532; 53/544, 551

[56] References Cited

U.S. PATENT DOCUMENTS

| | | | |
|---|---|---|---|
| 4,004,399 | 1/1977 | Borrello | 222/368 X |
| 4,718,217 | 1/1988 | Ross | 53/504 |

FOREIGN PATENT DOCUMENTS

| | | | |
|---|---|---|---|
| 505272 | 8/1954 | Canada | 222/368 |
| 588260 | 11/1933 | Fed. Rep. of Germany | 222/368 |

*Primary Examiner*—Michael S. Huppert
*Assistant Examiner*—Boris Milef
*Attorney, Agent, or Firm*—Robert M. Asher

[57] ABSTRACT

An apparatus for delivering product into a feed tube including a tip over drum which has a tray supported between two side walls. The tray has a convex hump near the axis of rotation for dividing product fed by a gravitational feed into two portions.

4 Claims, 2 Drawing Sheets

TIP-OVER DRUM

This is a continuation of co-pending application Ser. No. 07/166,119 filed on 3/10/88 now abandoned.

BACKGROUND OF THE INVENTION

Machines for filling boxes, bags and the like with articles such as cereal, popcorn and the like for deposit in boxes are generally provided with a hopper for receiving a quantity of articles for delivery into the upper end of a vertically-disposed tube on which the bag forming material is formed. Such apparatus known as vertical form fill seal machines are shown, for example, in U.S. Pat. No. 4,718,217. When using such apparatus for filling bags with larger articles such as cookies, crackers and the like, these articles may tend to clump together and hang in the throat of the hopper where it joins the vertically-disposed tube. It is the purpose of this invention to eliminate this problem by providing means for introducing the articles into the upper end of the tube in such a way as to avoid hangup.

In straight line weigher machines which have conventionally been used to fill boxes containing a liner with articles such as crackers and cookies, a tip-over drum 10 such as that shown in FIG. 1 has been used. The tip-over drum 10 receives the weighed load of product when its flat center tray portion 12 is approximately horizontal and delivers the product onto a feed slide 20. At each end of the tray there is an angled portion 14. The angled portion 14 furthest from the feed slide 20 retains the product within the drum as it turns. As the drum turns the product is caused to slide towards the angled portion 14 nearest the feed slide 20. The objective of the drum 10 is to cause the product to align flat against the drum's tray and then slide off the angled portion 14 so as to slide down the feed slide 20 while the product is on its flat side. With all of the product sliding on its flat side down the feed slide 20, the clumping problem was reduced in the straight line weighers.

It was found however that when the tip over drum of the prior art is used with a vertical form fill seal machine, clumping and hang up of the product was a major problem. In a vertical form fill machine the product is fed first into a tube of bag forming material after which the bag is sealed, cut and dropped into a box. In this machine, the feed slide is more narrow than in the straight line weigher thereby contributing to the hangup problem.

SUMMARY OF THE INVENTION

The apparatus for delivering product into a feed tube for filling bags includes a gravitational feed which drops a predetermined amount of product into a tip-over drum. The drum includes a tray having a convex hump near the axis about which the tray rotates. The hump divides the product falling from the gravitational feed into two portions. This advantageously aids in avoiding clumping of the product as it is poured into a feed tube. The product slides off the end portions of the tray and the tip-over drum onto a feed slide. The product slides down the feed slide and into the feed tube.

The tip-over drum is advantageously provided with two trays having convex humps so that after one has discharged product the other may be loaded with product from the gravitational feed. The process continues alternating between one tray and the other as the drum rotates.

Other objects and advantages of the invention will become apparent during the following description of the presently preferred embodiment of the invention taken in conjunction with the drawings.

DETAILED DESCRIPTION OF THE PREFERRED EMBODIMENT

Figure 1:
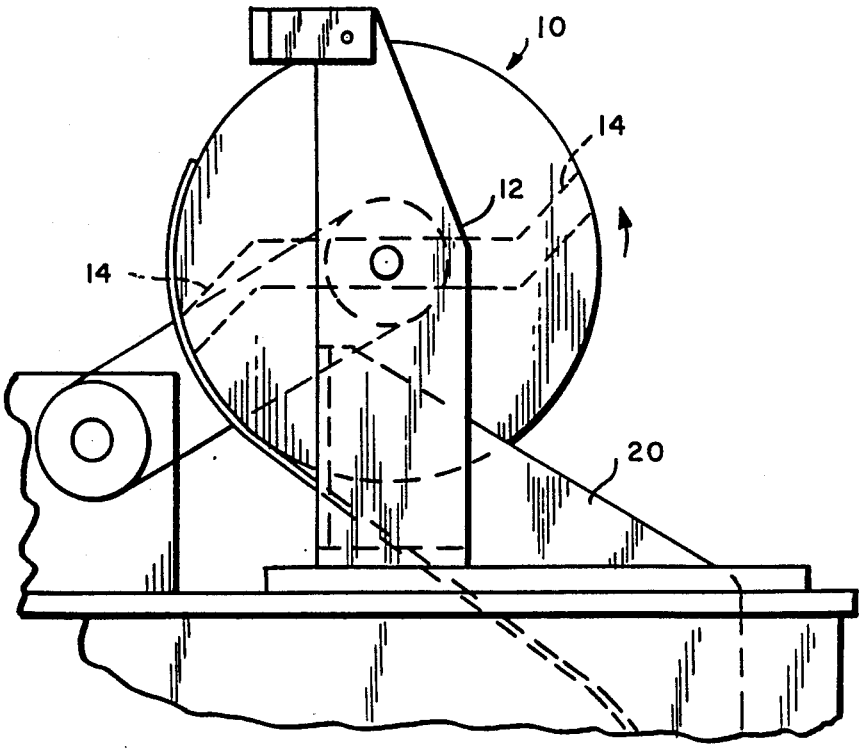
FIG.1 PRIOR ART
FIG. 1 is an elevational view of a tip-over drum used in prior art straight line weigher machines.
Figure 2:
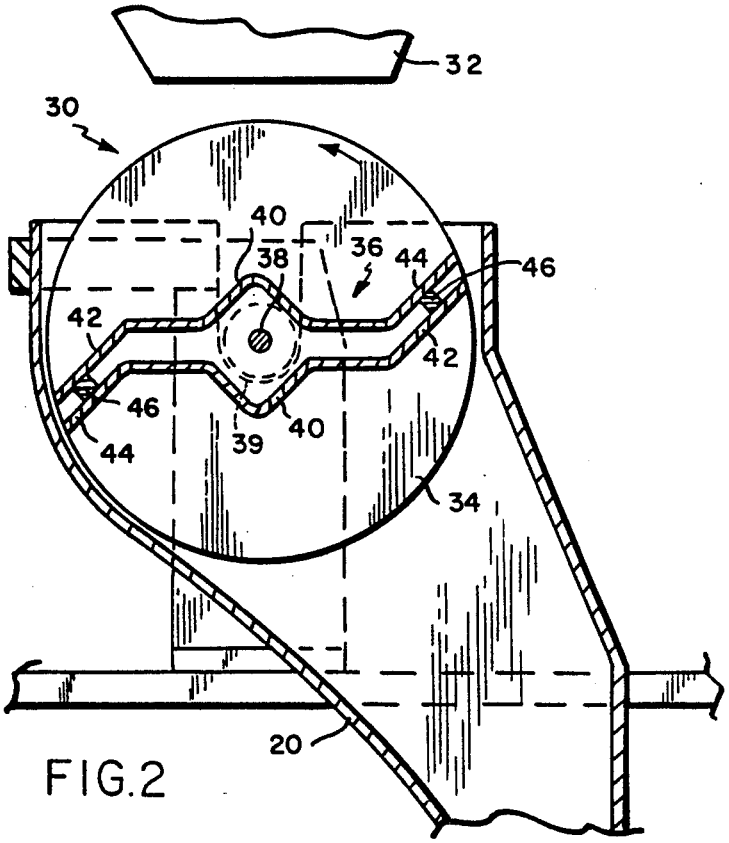
FIG. 2 is an elevational view of the tip-over drum of the present invention.

Referring to the drawings, there is shown, in FIG. 2, a tip-over drum 30 of the present invention. The product is dropped from a gravitational feed 32 into bags which are in turn dropped into cartons. The feed 32 may be a hopper with a latch door which opens after a predetermined amount of product is loaded into the hopper. Each load may for instance be a predetermined weight.

The tip over drum 30 includes two oppositely positioned round side walls 34 forming the two outer ends of the drum. A sheet metal tray 36 is supported between the two side walls 34. In the preferred embodiment, there are two trays 36 which are oppositely positioned about the axis of the round side walls 34. The two trays are separated from one another by spacer blocks 46. An axle 38 is provided at the axis for spinning the drum 30. The drum 30 has a hub 39 concentric with the axle 38.

In accordance with the present invention, each tray 36 includes a convex hump 40 located proximate to the axle 38. The convex hump 40 of the two trays 36 are preferably positioned circumferentially about the hub 39. A gravitational feed 32 is positioned relative to the tip-over drum 30 so that when it drops product, the product is divided relatively in half by the convex hump 40. Looking at FIG. 2, the tip-over drum 30 spins in a counter-clockwise direction. In accordance with the preferred embodiment, the end portions of the trays 36 are inclined in the direction of the rotation of the drum 30. The end portions 42 are the portions which the product slides off onto a feed slide 20. The incline of the end portions 42 is provided to facilitate the product especially when the product is comprised of flat objects, so that when the product slides off of the tray it is lying flat. At the end of the tray 36 opposite the end portions 42 there are corresponding end portions 44 which serve to retain the product on the tray 36 as the drum rotates. The convex hump 40 advantageously spreads out the product as it is slid onto the feed slide 20. If there was no hump 40, all of the product would be urged towards the feed slide 20 at once. By spreading out the delivery of the product to the feed slide 20, the present invention significantly reduces the likelihood that the product would jam or clump at the top of the relatively narrow feed tube of the vertical form fill seal machine.

In accordance with the presently preferred embodiment, the angle of the inclined portions 42 and 44 is 45 degrees from the adjacent portion of the tray 36. The angle made by the convex hump 40 with the adjacent portion of the tray is also 45 degrees. Typically, the tip-over drum 30 rotates at the speed of about 8 revolutions per minute.

Figure 3:
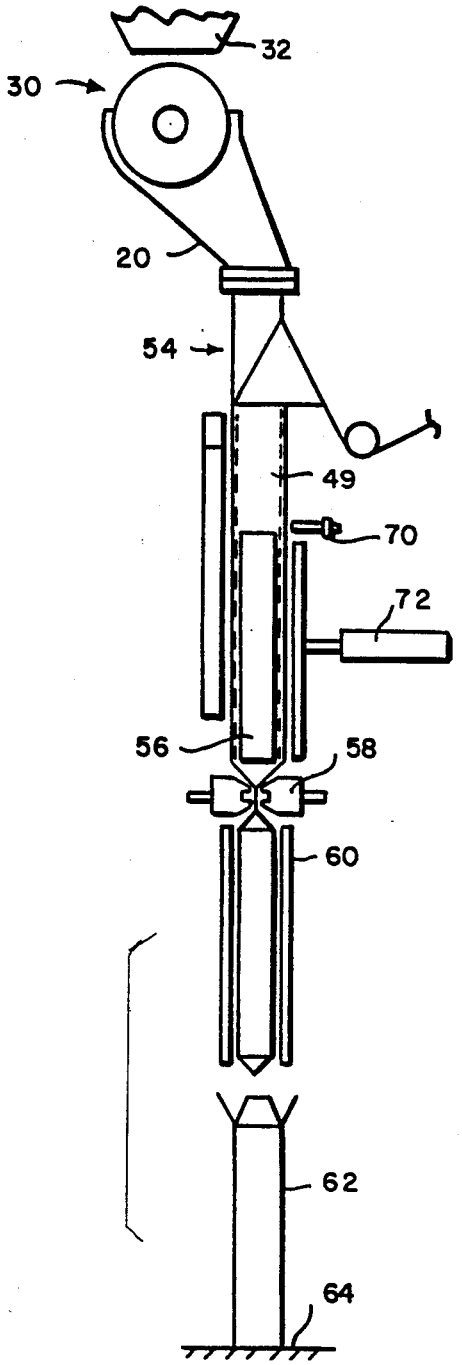
FIG. 3 is an end view of a vertical form fill seal machine being fed by the tip-over drum of FIG. 2.

Referring now to FIG. 3, a vertical form fill seal machine using the present invention is shown. Bag forming material 49 is formed about a feed tube 54 and is pulled down about the feed tube 54 by rollers 56. Jaws 58 are provided for sealing and severing the bag material. When the bag material has been sealed, a predetermined amount of material may be dropped from the gravitational feed 32 into the tip-over drum 30. The tip-over drum 30 pours product down the feed slide 20 and into the feed tube 54 to fill the bag. After the bag has been filled it is lowered by the rollers 56 beneath the jaws 18. The bag as it is dropped beneath the jaws 58 is dropped into a shape-retaining means 60. The jaws then seal the top of the bottom bag and thus the bottom of the bag material extending about the feed tube 54. The jaws also cut the sealed area so as to drop the filled bag into a carton 62 waiting beneath the machine on a support base 64 such as a conveyor belt. The vertical form fill seal machine may be provided with an optional sensor 70 and an optional vibrator 72 to help reduce the product below a predetermined maximum height in the bag. A vertical form fill seal machine is described in greater detail in U.S. Pat. No. 4,718,217 and in U.S. patent application Ser. No. 143,076, filed Jan. 12, 1988, both of which are owned by the same assignee as the present application and both of whose disclosures are hereby incorporated by reference herein.

The present invention advantageously minimizes the likelihood of clumping or hangup at the top of the feed tube 54, thereby reducing the down time of a vertical form fill seal machine being filled with large flat objects such as cookies or crackers.

Of course, it should be understood that various changes and modifications to the preferred embodiment described above will be apparent to those skilled in the art. For example, the trays 36 may be rotated within the side walls without the need to rotate the side walls as well. The radial arms of the two trays may be actually formed by a single piece of sheet metal which acts as one tray on one side and as the other tray on its other side. These and other changes can be made without departing from the spirit and the scope of the invention and without diminishing its attendant advantages. It is therefore intended that such changes and modifications be covered by the following claims.

What is claimed is:

1. Apparatus for delivering product into a feed tube comprising:

gravitational feed means for dropping a predetermined amount of said product;

a tip-over drum for receiving said product dropped by said gravitational feed means, said drum including two spaced, parallel sidewalls, a diametrically disposed tray supported between said sidewalls which rotates about an axis that extends perpendicular to said sidewalls and a hub concentric with said axis, said tray including a convex hump positioned circumferentially about said hub and said tip-over drum being positioned so that the hump is centered directly beneath said gravitational feed means for dividing said product into two portions when it is received from said feed means, one portion of said product landing on a downwardly moving side of said tray and the other portion landing on an upwardly moving side of said tray; and feed slide means positioned with respect to said drum for receiving said product from said drum as it slides off the downwardly moving side of said tray while a portion of the product is temporarily detained by said convex hump, said feed slide means also directing said product into said feed tube.

2. The apparatus of claim 1 further comprising a second tray supported between the two sidewalls of said tip-over drum so that said two trays can be alternately loaded with the product from said gravitational feed means as said trays are rotated.

3. The apparatus of claim 1 wherein said tray includes oppositely extending planar portions connected to said convex hump and second portions at the opposite ends of the first portion disposed in the direction of rotation at oblique angles to the first portions, wherein the second portion on the upwardly moving side of the tray helps hold said product in said tray as the tray rotates.

4. The apparatus of claim 3 wherein the second portion on the downwardly moving side of the tray is inclined so that product sliding off said second portion will generally lie flat.

* * * * *